US006651496B2

(12) United States Patent
Van Steenwyk et al.

(10) Patent No.: US 6,651,496 B2
(45) Date of Patent: Nov. 25, 2003

(54) INERTIALLY-STABILIZED MAGNETOMETER MEASURING APPARATUS FOR USE IN A BOREHOLE ROTARY ENVIRONMENT

(75) Inventors: Donald H. Van Steenwyk, San Marino, CA (US); James N. Towle, Seattle, WA (US); Hans S. Fairchild, Paso Robles, CA (US)

(73) Assignee: Scientific Drilling International, Houston, TX (US)

( * ) Notice: Subject to any disclaimer, the term of this patent is extended or adjusted under 35 U.S.C. 154(b) by 0 days.

(21) Appl. No.: 10/217,367

(22) Filed: Aug. 12, 2002

(65) Prior Publication Data

US 2003/0041661 A1 Mar. 6, 2003

Related U.S. Application Data

(60) Provisional application No. 60/316,882, filed on Sep. 4, 2001.

(51) Int. Cl.[7] ..... E21B 47/12; E21B 47/022; G01V 1/40

(52) U.S. Cl. ..... 73/152.03; 33/304; 702/6; 702/9

(58) Field of Search ..... 73/152.03, 152.54; 33/304; 701/220; 702/6, 9

(56) References Cited

U.S. PATENT DOCUMENTS

| | | | | |
|---|---|---|---|---|
| 4,472,884 | A | 9/1984 | Engebretson | 33/304 |
| 4,542,647 | A | 9/1985 | Molnar | 73/152.54 |
| 4,812,977 | A | 3/1989 | Hulsing, II | 702/6 |
| 6,347,282 | B2 | 2/2002 | Estes et al. | 702/6 |
| 6,453,239 | B1 | 9/2002 | Shirasaka et al. | 701/220 |
| 6,459,992 | B1 | 10/2002 | Freedman et al. | 702/6 |
| 6,529,834 | B1 | 3/2003 | Estes et al. | 702/9 |
| 2002/0116130 | A1 | 8/2002 | Estes et al. | 702/9 |
| 2002/0133958 | A1 | 9/2002 | Noureldin et al. | 33/304 |

*Primary Examiner*—Hezron Williams
*Assistant Examiner*—J L Politzer
(74) *Attorney, Agent, or Firm*—William W. Haefliger

(57) ABSTRACT

A measurement apparatus for making magnetic and gravity component measurements in a borehole, including measurements made while the apparatus is rotating about the borehole axis, comprising a magnetic field component sensing device having at least two axes of sensitivity normal to the borehole axis and normal to each other, a gravity field component sensing device having at least two axes of sensitivity normal to the borehole axis and normal to each other, an inertial angular rotation sensing device having an axis of sensitivity along the borehole axis to sense inertial angular motion about the borehole axis, control, power and processing circuitry to operate said sensing devices and to process the outputs of said sensing devices to obtain stabilized component data in a coordinate system that does not rotate with the said measurement apparatus, communication circuitry to transmit output data to auxiliary equipment at the surface or in the borehole, and support structure to support the sensing devices.

15 Claims, 4 Drawing Sheets

INERTIALLY-STABILIZED MAGNETOMETER MEASURING APPARATUS FOR USE IN A BOREHOLE ROTARY ENVIRONMENT

This non-provisional application is based on provisional application Serial No. 60/316,882, filed Sep. 4, 2001.

BACKGROUND OF THE INVENTION

In various operations related to the drilling of boreholes in the earth for purposes of production of gas, oil or other products, rotary drilling mechanisms are well known. In the process of controlled-direction drilling, often referred to a Measure While Drilling (MWD), apparatus using magnetometers and accelerometers is used to determine the direction of the borehole. However, if the magnetometers and accelerometers employed in the direction sensing apparatus are in rotation along with the drill string and drill bit, substantial inaccuracy problems result. General practice has been to stop drilling when measurements of borehole attitude are required. In the process of determining borehole inclination and azimuthal direction, from the magnetometer and accelerometer data, it is necessary to transform the measured data into an earth-fixed coordinate set.

Several patents disclose the use of means to compute borehole direction parameters while drill string rotation continues, so that it is not necessary to stop the drilling process to make measurements. Examples of such patents are U.S. Pat. Nos. 4,813,274, 4,894,923, 5,012,412 and 5,128,867. All of these provide means to process the data from the magnetometer and accelerometer sensors in such a manner that the data obtained and related to inclination and azimuthal direction of the borehole can be isolated from the rotary environment.

These prior methods remain sensitive to the dynamics of the rotary motion of the drilling apparatus as drilling progresses. If the drilling continues at a near constant-rotation rate for the drill bit, reasonable results can be obtained. However, if the drill bit undergoes what is known as stick-slip rotary motion, serious errors may be encountered. The stick-slip phenomenon is one in which the drill bit may become stuck in the formation, a large twist may then be built up in the drill string from the bottom hole location of the bit to the surface, and when the bit becomes free the drill string will rapidly spring back with a very high instantaneous untwisting rotation rate for the downhole assembly that carries the magnetometer and accelerometer sensor. Under such conditions, the prior methods referred to above may lead to substantial error in the desired output information.

U.S. Pat. No. 4,472,884 shows a magnetic survey tool and use of a rotary drive about the borehole axis. However, this tool does not provide any isolation of input angular rates about the borehole axis, and instead uses the rotary drive to make multiple measurements about the borehole axis.

It is a major object of this invention to provide apparatus and method to overcome problems as referred to, through provision of an inertial angular rotation sensor having an axis of sensitivity along the borehole direction to stabilize either the direction of measurement or the resulting data from the magnetometer and accelerometer data provided by the magnetic field and acceleration sensors.

SUMMARY OF THE INVENTION

Apparatus provided by the invention includes a set of magnetometers for measuring components of the earth's magnetic field, a set of accelerometers for measuring components of the earth's gravity field and an inertial angular rotation sensor having an axis of sensitivity along the direction of the borehole axis. Control, power and processing circuitry is provided to operate these sensing devices and to process the outputs of the sensing devices to obtain stabilized component data in a coordinate system that does not rotate with the the measurement apparatus.

In one embodiment, a rotary drive means is provided to rotate the sensing devices, and about an axis of rotation along the borehole axis. Such drive means is then stabilized in inertial space using the output of the inertial angular rotation sensor as a reference. Various modes of operation and control are provided for the drive means, and may include one or more of the following:

1. Stabilization directly to the inherent null output of the inertial angular rotation sensor;
2. Stabilization in any fixed position about the borehole axis using the inertial angular rotation sensor, but:
   a) referenced to accelerometer data,
   b) referenced to magnetometer data,
   c) referenced to a rotation angle sensor provided as part of the rotary drive means;
3. Continuous or intermittent rotation of the sensing devices, but controlled accurately to any selected rate, or to any desired number of stopping points.

In such modes of operation, the primary stabilization reference is the inertial angular rotation sensor. The specific modes referred to above may be achieved by combining other data into the control means for the rotary drive, along with the output of the inertial angular rotation sensor. The inertial angular rotation sensor may be an inertial angular accelerometer, an inertial angular rate sensor or an inertial angle sensor.

In another alternative embodiment, no rotary drive means is provided. The output of the inertial angular rotation sensor is used to directly stabilize, by computation, the outputs of the cross-borehole magnetometer and accelerometer sensors into an earth-fixed coordinate set.

These and other objects and advantages of the invention, as well as the details of an illustrative embodiment, will be more fully understood from the following specification and drawings, in which:

DRAWING DESCRIPTION

Figure 2:
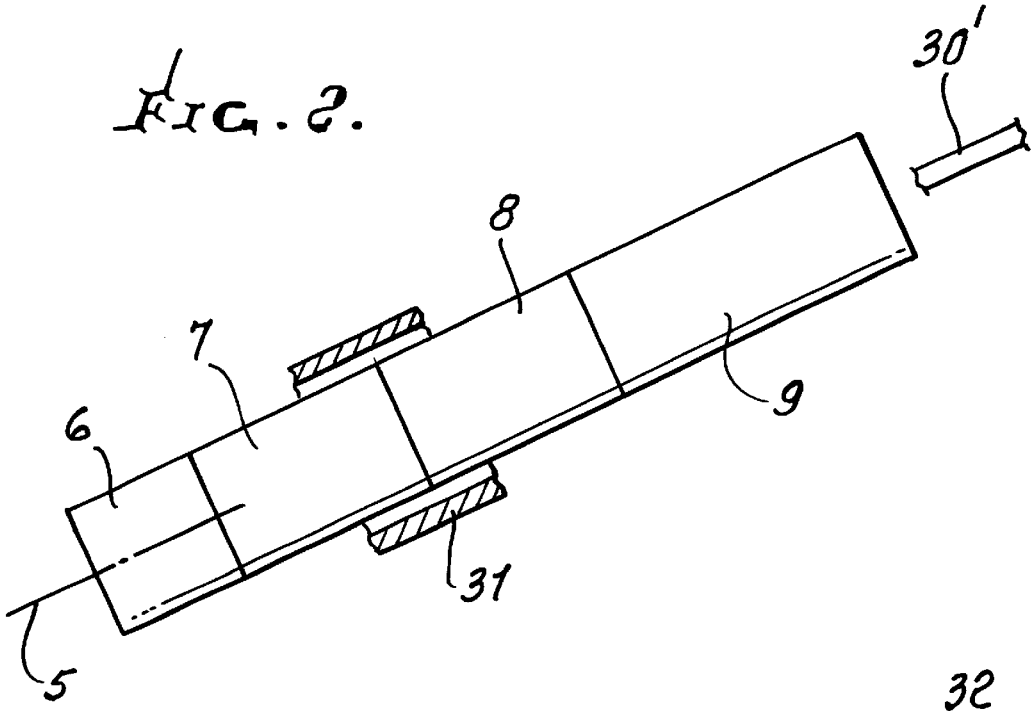
FIG. 2 is a diagrammatic representation of a preferred tool having magnetic and gravity sensors and an inertial angular rotation sensor, in a borehole.
Figure 3:
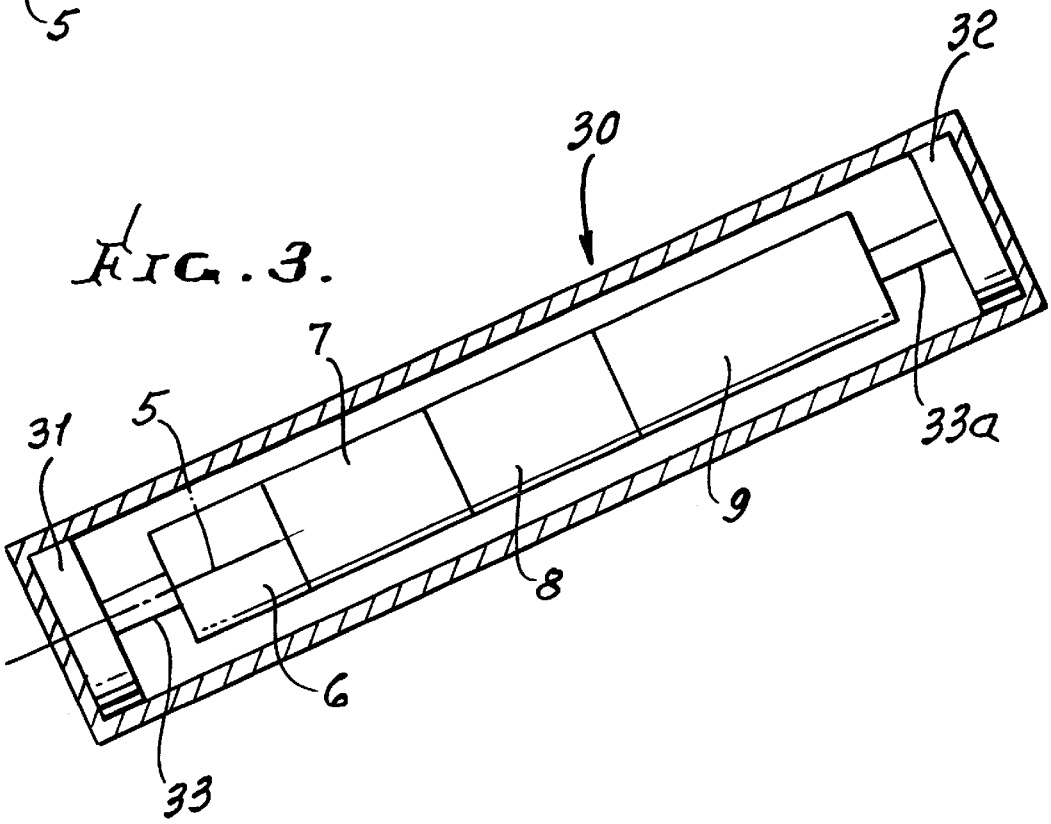
Figure 2A:
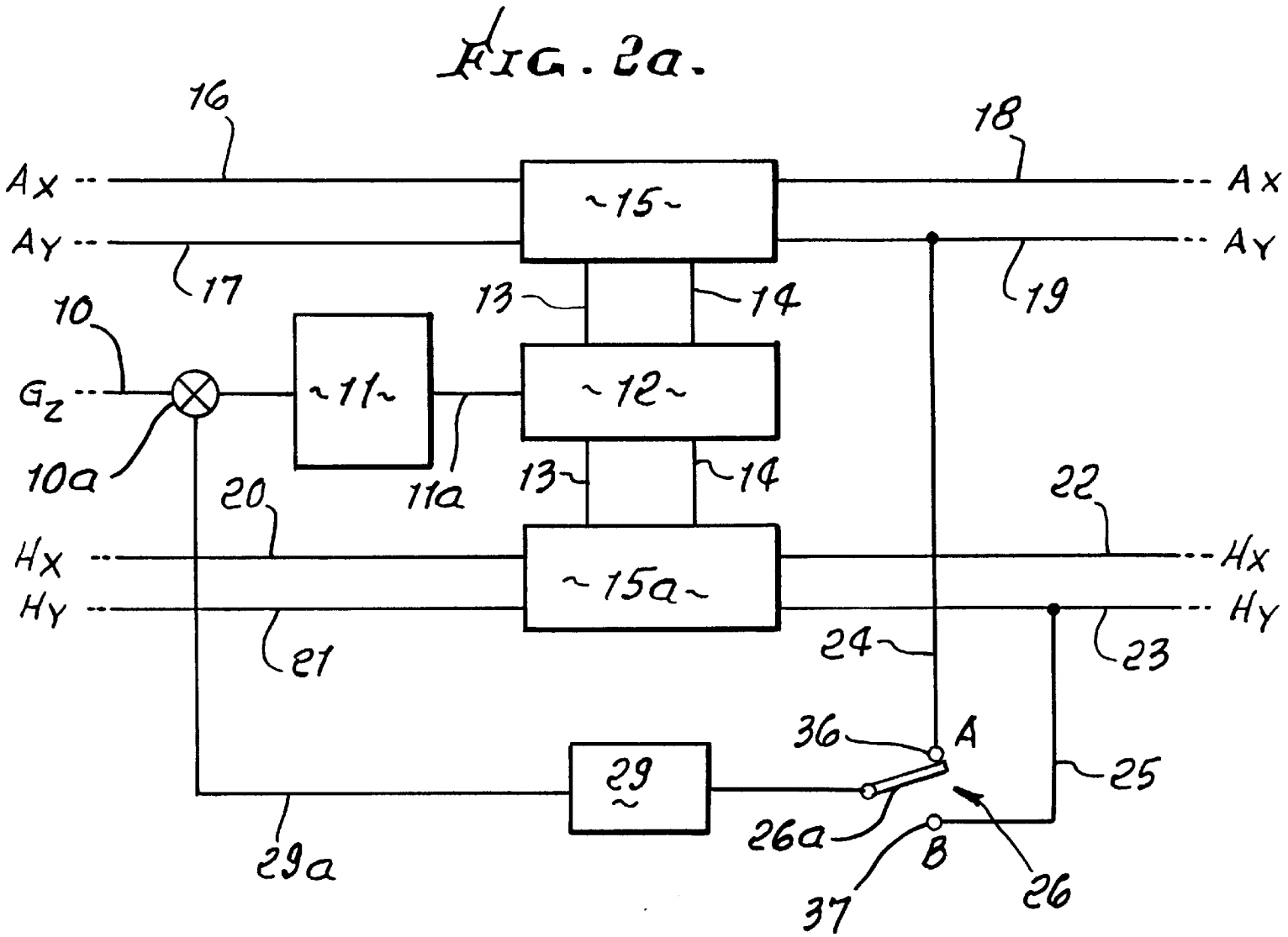
Figure 4:
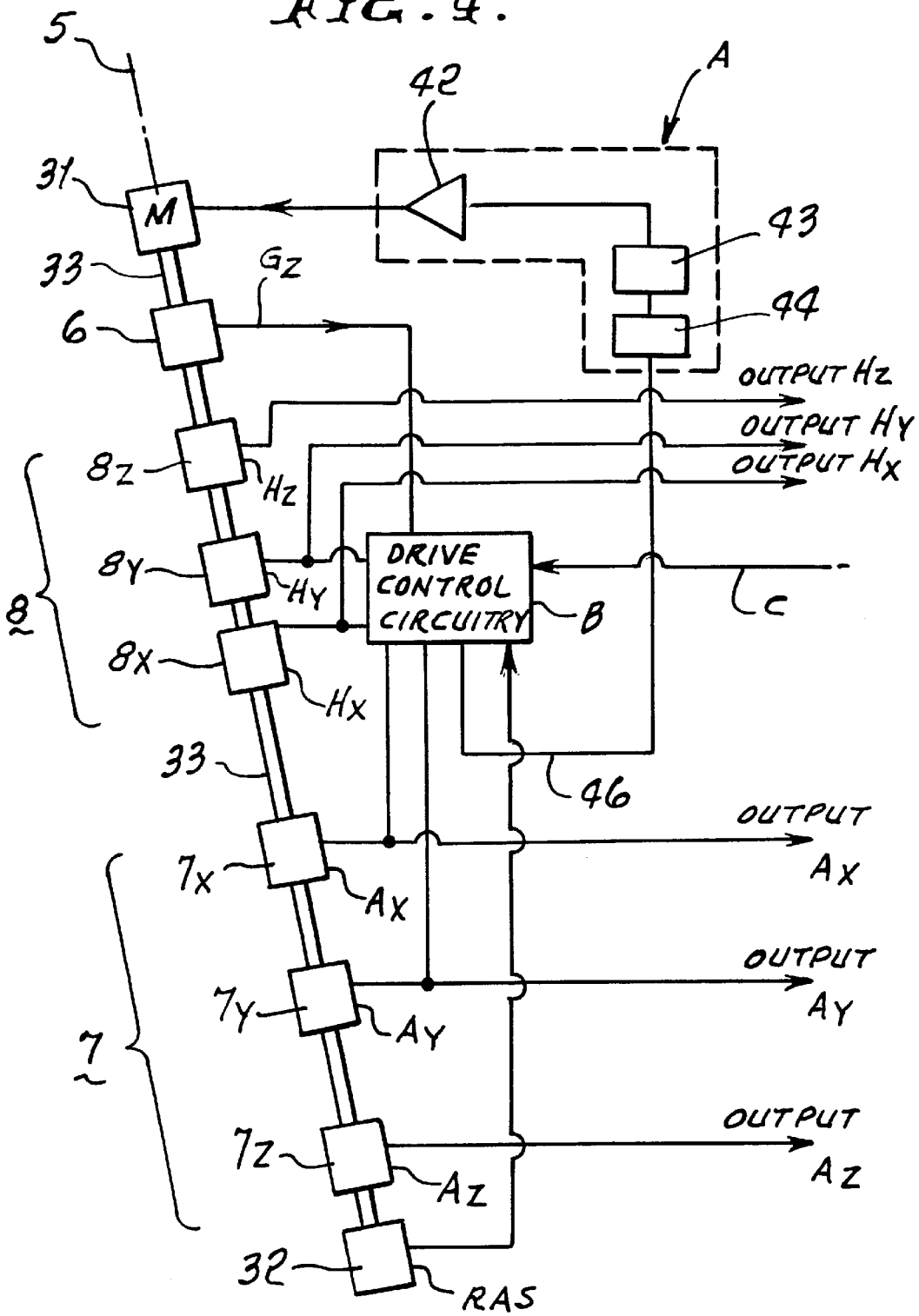

FIG. 2*a* is a block diagram of the information flow and computation associated with operation of the apparatus of FIG. 2;

FIG. 3 shows another embodiment of the tool or apparatus of FIG. 2 that includes a rotary drive assembly to permit direct stabilization of the orientation of the sensors about the borehole axis; and FIG. 4 is a block diagram of useful alternative connections of control and stabilization circuits, for the apparatus of FIG. 3.

DETAILED DESCRIPTION

In a borehole measurement system for making measurements of components of the earth's magnetic and gravity fields, typical apparatus tools include a magnetic field component sensing device having at least two axes of sensitivity normal to the borehole axis and normal to each other, and a gravity field component sensing device having at least two axes of sensitivity normal to the borehole axis and normal to each other. There may also be included a magnetic field component sensing device and a gravity field component sensing device having an axis of sensitivity along the borehole axis. Such magnetic field component sensing devices may be of the well known flux gate design, may be magnetoresistive devices, or other devices that provide a vector measurement of the magnetic field component along a sensitive axis direction. The gravity field component sensing devices may be well known force-balance accelerometers, or other devices that provide a vector measurement of the gravity component along a sensitive axis direction.

In such systems, it is well known to define a coordinate system fixed in the borehole at a known location that defines the borehole orientation. In general, an X-axis coordinate may be established as normal to the borehole and in a vertical plane, a Y-axis coordinate that is horizontal and normal to the X-axis, and a Z-axis that is along the borehole axis direction. Further, a coordinate system fixed in a borehole measurement system may be defined that is rotated about the borehole axis by some angle, which for example may be considered as a tool face angle, TF. In this coordinate system the axes may be the x-axis, the y-axis and the z-axis which are rotated by the angle TF from the XYZ system. Note that since the only rotation considered is about the borehole Z-axis direction, the z-axis of the rotated coordinate system is co-linear with the Z-axis along the borehole direction.

When the measurement devices, for magnetic and gravity components, are used in a tool that rotates as the drill string is being rotated, those devices having their axes of sensitivity normal to the borehole will generally show a sinusoidal response vs. rotation angle since each sensor changes its direction with respect to the fixed component to be measured.

Figure 1:
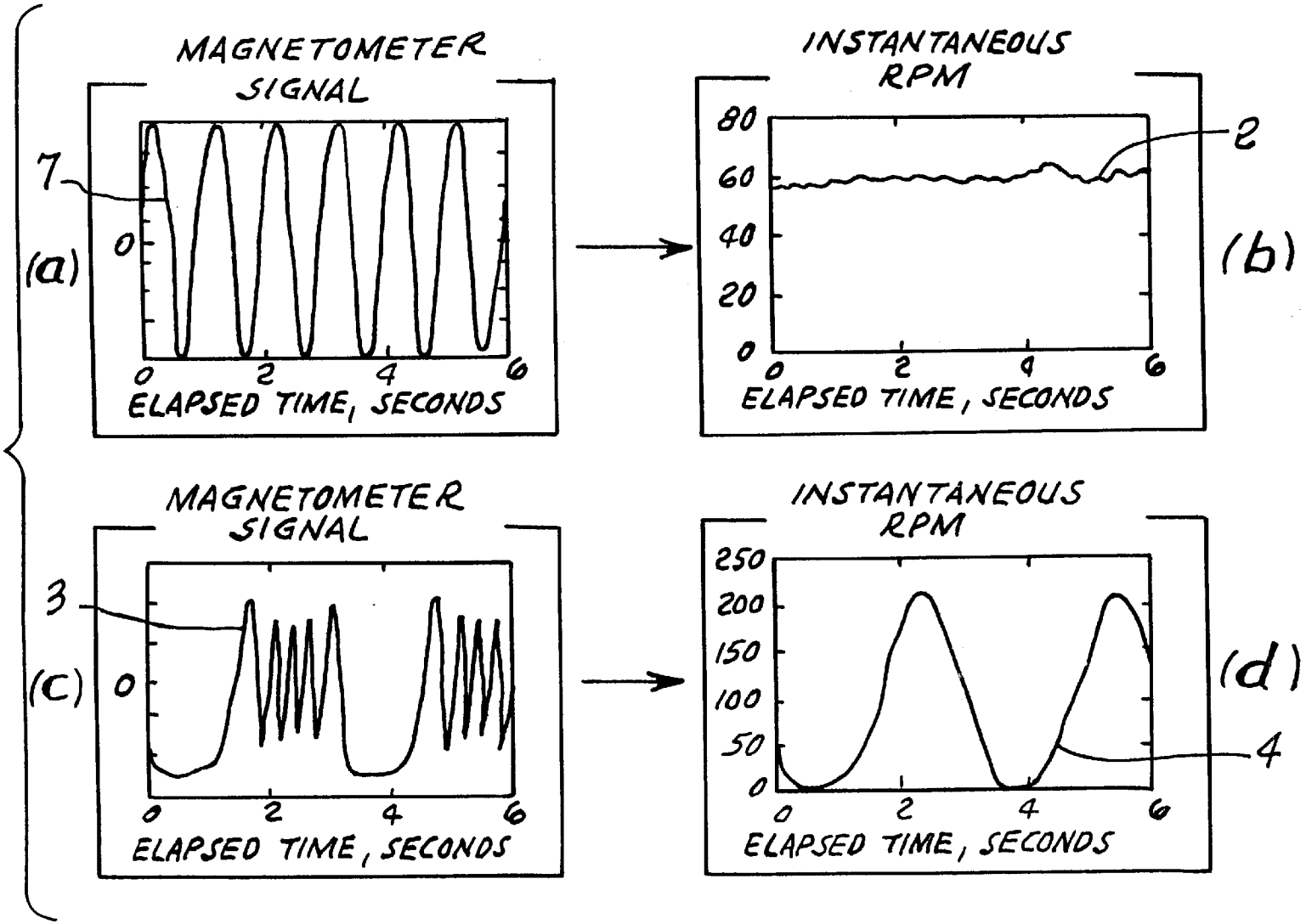
FIG. 1 shows at (*a*), (*b*), (*c*) and (*d*) samples of a magnetometer signal and an instantaneous rotation speed, for two conditions of a rotary magnetic sensing tool in a borehole.

FIG. 1*a*) shows a typical magnetometer signal 1 for a condition in which the instantaneous revolutions per minute (RPM) 2 in FIG. 1*b*) the nominal rotation rate, is generally nearly a constant rate. In FIG. 1*c*) the magnetometer signal 3 shows the effect of what is known as a stick-slip condition on the drill string rotation. In this case, the drill bit tends to lock into the formation being drilled and stops rotating. The drill string above the bit continues to be driven at its upper end, perhaps several thousand feet away, and the drill string resiliently twists, building up a large torque on the bit at the lower end of the drill string. As shown, the instantaneous RPM 4 seen in FIG. 1*d*) goes from a near-zero value to a high value and back again through what may become a continuing cyclical stick-slip condition. The cross-borehole gravity component sensing devices will show a generally similar response. In such conditions, extremely high sampling rates may be necessary for the sensors to provide even marginally acceptable response.

FIG. 2 shows one embodiment of the present invention. The borehole axis 5 provides a reference direction. An inertial angular rotation sensing device 6 has an axis of sensitivity along the borehole axis 5 and senses inertial angular motion about that axis. A gravity field component sensing device 7 has at least two axes of sensitivity normal to the borehole axis and normal to each other for sensing gravity components. Generally, this device may also have an additional axis of sensitivity along the borehole axis direction. A magnetic field component sensing device 8 has at least two axes of sensitivity normal to the borehole axis and normal to each other and senses magnetic field components. Generally, this device may also have an additional axis of sensitivity along the borehole axis direction. Control, power and processing circuitry is provided at 9, and has elements that control or operate the sensing devices 6, 7 and 8, process the outputs of the sensing devices to obtain stabilized component data in a coordinate system that does not rotate with the measurement apparatus, and provide communication circuitry to transmit output data to the surface or to other adjacent equipment in the borehole. See transmission line 301. Rotating well pipe is indicated at 31, and contains elements 6–9.

FIG. 2*a* is a block diagram showing elements used to resolve the cross-axis measured components of the gravity field, designated as $A_x$ and $A_y$, and the cross axis measured components of the magnetic field, designated $H_x$ and $H_y$ such resolution being from the rotating x, y, z-coordinate set defined above to the fixed X, Y, Z-component coordinate set also defined above. In the following equations, TF is the tool face angle relating the angular orientation either to the gravity vectors $A_x$ and $A_y$ or to the magnetic field vectors $H_x$ and $H_y$:

$$A_X = A_x \star \text{Cos}\ (TF) - A_y \star \text{Sin}\ (TF) \quad (1)$$

$$A_Y = A_x \star \text{Sin}\ (TF) + A_y \star \text{Cos}\ (TF) \quad (2)$$

$$H_X = H_x \star \text{Cos}\ (TF) - H_y \star \text{Sin}\ (TF) \quad (3)$$

$$H_Y = H_x \star \text{Sin}\ (TF) + H_y \star \text{Cos}\ (TF) \quad (4)$$

where Sin is the Sine of the angle and Cos is the Cosine of the TF angle.

The block diagram indicates how the output of the inertial angular rotation sensing device is used together with the outputs of the gravity field component sensing device and the magnetic field component sensing device to perform the functions shown by Equations (1) through (4). The inertial angular rotation sensor device is considered to be an inertial-angular-rate-measuring gyroscope. As such, since its axis of sensitivity is along the borehole axis, it measures the time rate of change of the toolface angle, TF, or dTF/dT. This signal, labeled $G_z$ at 10, is connected to a summing junction 10*a* and then to an integrator device 11 to provide an output 11*a* which is a representation of the toolface angle TF. The TF-angle is inputted to a sine/cosine computing device 12 that provides the values of the sine and cosine of the angle TF at leads 13 and 14. These sine and cosine values are connected to two component resolution computing devices 15 and 15*a*, the upper one 15 implementing equations (1) and (2) and the lower one 15*a* implementing equations (3) and (4). The two cross-borehole measurements of the gravity field, $A_x$ at 16 and $A_y$ at 17, which are in the rotating tool coordinates, are inputed to the upper component resolution computing device 15. The outputs of this device are $A_X$ at 18 and $A_Y$ at 19, which are in a fixed non-rotating coordinate system. The two cross-borehole measurements of the magnetic field, $H_x$ at 20 and $H_y$ at 21, which are in the rotating tool coordinates, are inputed to the lower component resolution computing device 15*a*. The outputs of this device are $H_X$ at 22 and $H_Y$ 23, which are in a fixed non-rotating coordinate system. The signal $G_z$ at 10 may have bias-type or other errors that would result in a continually-increasing error in the output TF angle at 11*a*. To correct for this, leads 24 and 25 connect $A_Y$ and $H_Y$ respectively to two poles 36 and 37 and of a switch 26, which permits selection of either of the signals at the poles to be connected to error-correction circuit 29. The output of this circuit is connected to summing junction 10*a* by lead 29*a* so as to subtract a correction signal from the input $G_z$ and correct the assumed error. If switch arm 26*a* is in pole position 36 or A, then the error correction is derived from the gravity component output data and the resolved output components are referenced to the earth's cross-borehole gravity component. If switch arm 26*a* is in pole position 37 or B then the error correction is derived from the magnetic field component output data and the resolved output components are referenced to the earth's cross-borehole magnetic field component.

FIG. 3 shows another embodiment of the invention which may be preferred in some cases. If the expected instantaneous rotation rate of the drill string, during either regular operation or stick-slip conditions is very high, it may be difficult to provide an inertial angular rotation sensing device of suitable performance and cost. Further, if the frequency response or bandwidth of measurement of the magnetic field component sensing device, and/or the gravity field component sensing device, is not sufficient to provide the desired measurements without excessive phase lag in the data, then such sensors should not be used. The apparatus of FIG. 3 provides direct stabilization of the mechanical orientation of the sensors rather than the mathematical stabilization provided by the apparatus of FIGS. 2 and 2*a*. In FIG. 3 the apparatus is aligned with the borehole axis 5. See elements 6–9. A housing or support structure 30 contains a rotary drive mechanism having a motor 31 at one end and a rotation angle sensor device 32 at the other end. Shaft sections 33 and 33*a* support the sensor elements at opposite ends of those elements. The latter include an inertial angular rotation sensing device 6 having an axis of sensitivity along the borehole axis 5 and senses inertial angular motion about the borehole axis; and a gravity field component sensing device 7 having at least two axes of sensitivity normal to the borehole axis and normal to each other to sense gravity components. Generally, the device may also have an additional axis of sensitivity along the borehole axis direction. The sensor elements also in include a magnetic field component sensing device 8 having at least two axes of sensitivity normal to the borehole axis and normal to each other to sense magnetic field components. Generally, this device may also have an additional axis of sensitivity along the borehole axis direction. Control, power and processing circuitry is provided at 9. These elements operate the sensing devices, process their outputs to obtain reference information for stabilization of the sensors in a coordinate system that does not rotate with the measurement apparatus, and provide communication circuitry to transmit output data to surface equipment or to other adjacent equipment in the borehole. Control, power and processing circuitry 9 may be carried on the rotary drive mechanism as shown as by 33 and 33*a*, or may be mounted as part of the housing or support structure 30.

In the apparatus of FIG. 3, the motor 31 may be a DC electric motor, an AC electric motor, a stepper motor or some variety of motor with a gear train. The rotation angle sensor device 32 may have one or more detent positions about the rotation axis, one or more angular motion stop positions about the rotation axis, or one or more discrete-point electrical or magnetic sensors, to indicate specific angular orientations. Alternatively, it may be a continuous angle measurement device such as an electromagnetic resolver or potentionmeter.

FIG. 4 shows a possible alternative connections of the control and stabilization circuits for the apparatus of FIG. 3. The borehole axis 5 indicates the general alignment of the elements related to the rotary drive mechanism. One of these is an inertial angular rotation sensing device 6 having an axis of sensitivity along the borehole axis to sense inertial angular motion about the borehole axis. Its output is labeled $G_z$ to indicate that it senses rotary motion about the z-axis along the borehole axis. A magnetic field component sensing device 8, is broken into three components 8*x*, 8*y* and 8*z* to indicate that three components are sensed. These components are labeled $H_x$, $H_y$ and $H_z$.

A gravity field component sensing device 7, is also broken into three components 7*x*, 7*y* and 7*z* to indicate that three components are sensed. These components are labeled $A_x$ $A_y$ and $A_z$. A rotation angle sensor device 32 is shown at the lower end of the apparatus. Shaft or structure segments 33 are shown to support and connect the other elements. Outputs from the magnetic and gravity sensing devices are shown at the right as all being available to outside other equipment. These outputs are in the same coordinate system as the sensors which may be stabilized in a variety of ways.

Various modes of operation and control are provided for this drive means. Such modes may include:

1. Stabilized directly to the inherent null output of the inertial angular rotation sensor
2. Stabilized in any fixed position about the borehole axis using the inertial angular rotation sensor but:
   a. referenced to accelerometer data
   b. referenced to magnetometer data
   c. referenced to a rotation angle sensor provided as part of the rotary drive means.
3. Continuous or intermittent rotation but controlled accurately to any selected rate or to any desired number of stopping points.

In these modes of operation, the primary stabilization reference is the inertial angular rotation sensor. Drive control circuitry B accepts inputs from the inertial angular rotation sensor 6, the two cross-borehole magnetic field component sensors 8*x* and 8*y* and the two cross-borehole gravity field component sensors 7*x* and 7*y*. An input shown at C provides mode control for the drive control circuitry B and may also provide an external reference signal. The output of the drive control circuitry B is shown at 46 and is connected to servo electronics at A that comprises signal input circuits 44, servo frequency compensation 43 and power amplification 42 to drive motor 31.

Within the drive control circuitry B there are several options provided:

1. The output 46 of circuitry B may be derived solely from the input from the inertial angular rotation sensor 6, signal Gz. This results in the mode numbered 1 in the above list. In this mode, the angular orientation of the stabilized sensors may drift slowly from the desired position but the orientation is still stabilized nominally in space. Known methods can then be used to obtain earth-fixed components. See for example U.S. Pat. No. 4,433,491.
2. The output 46 of circuitry B may be derived from the input from the inertial angular rotations sensor combined with the outputs from either or both of the gravity field component sensors 7*x* and 7*y*. This mode may be used, for example, to null the output of sensor 7*y* and thus maintain the y-axis of the coordinate system in a horizontal plane. Similarly, it may be used to null the output of sensor 7*x*, thus maintaining the x-axis of the coordinate system in a horizontal plane. Or by nulling some combination of the sensors 7*x* and 7*y* any desired orientation may be obtained. This results in the mode numbered 2*a* in the above list. This mode is generally useful when the borehole inclination angle is significantly greater than zero. With a small inclination angle, both gravity sensor outputs will be small and poor results may result.

3. When the borehole inclination angle is small, it will usually be desirable to stabilize the sensors with respect to the magnetic field component data. To do this, outputs of the magnetic field component sensors 8*x* and 8*y* are used in place of the gravity field component sensors 7*x* and 7*y* just as described in the previous paragraph. This results in the mode numbered 2*b* in the above list.

4. In certain operations it may be desirable to position the attitude of the elements using inputs from the rotation angle sensor to position the elements as desired. This results in the mode numbered 2*c* in the list above.

5. The input C in FIG. 4 may also provide an external reference signal. This may be of any form and may be combined with any of the other sensor inputs to achieve the results in the mode numbered 3 in the list above.

Further, in another and quite simple embodiment of the apparatus of FIG. 3 and FIG. 4, and as an alternative to the typical apparatus indicated at the beginning of this description, the gravity field component sensing device and the magnetic field component sensing device may each have only a single axis of sensitivity normal to the borehole axis. With this configuration of sensitive axes, it is necessary to take multiple measurements at discretely different angular positions about the borehole axis to obtain independent complete survey measurements of borehole inclination and azimuth. Also, it is possible in this configuration to stabilize the sensitive axes in any desired angular orientation about the borehole as the drill string is advanced into the borehole formation. One example would be the stabilization of the sensors such that the gravity field component sensing device has its output nulled. This also fixes the orientation of the magnetic field component sensing device. Tool face direction of the tool assembly can then be read from the cited rotation angle sensor.

In an alternative embodiment, only a single magnetometer or accelerometer could be provided normal to the borehole axis.

As another alternative, the inertial angular rate sensing device may be considered to just be the inertial of the total gimbal or rotating element of the rotary drive. As such, the inertia would serve to isolate the rotating element from the outer structure for high angular accelerations. This inertial element could be either pendulous or non-pendulous as desired. If a pendulous design is used, the center of mass is intentionally offset radially from the center of rotation axis of the gimbal. In steady state such a pendulous member would tend to align with the cross-borehole component of the earth gravity vector.

We claim:

1. A measurement apparatus for making magnetic and gravity component measurements in a borehole, including measurements made while the apparatus is rotating about the borehole axis, comprising:

a) a magnetic field component sensing device having at least two axes of sensitivity normal to the borehole axis and normal to each other, b) a gravity field component sensing device having at least two axes of sensitivity normal to the borehole axis and normal to each other, c) an inertial angular rotation sensing device having an axis of sensitivity along the borehole axis to sense inertial angular motion about the borehole axis, d) control, power and processing circuitry to operate said sensing devices and to process the outputs of said sensing devices to obtain stabilized component data in a coordinate system that does not rotate with the said measurement apparatus, e) and including a rotary drive mechanism, having a gimbal to support said a), b) and c) sensing devices, said rotary drive mechanism controlled by said c) inertial angular rotation sensing device, for example a gyroscope, to rotate said a) sensing device about the borehole axis, or to permit stabilization of the gimbal and the sensitive axes of said a) sensing device with respect to a fixed coordinate system, for example inertial space.

2. A measurement apparatus for making magnetic and gravity component measurements in a borehole, including measurements made while the apparatus is rotating about the borehole axis, comprising:

a) a magnetic field component sensing device having at least two axes of sensitivity normal to the borehole axis and normal to each other, b) a gravity field component sensing device having at least two axes of sensitivity normal to the borehole axis and normal to each other, c) an inertial angular rotation sensing device having an axis of sensitivity along the borehole axis to sense inertial angular motion about the borehole axis, d) a rotary drive mechanism to rotate the said sensing devices about the borehole axis or to permit stabilization of the sensitive axes of said sensing devices with respect to a fixed coordinate system, e) control, power and processing circuitry to operate said sensing devices and to process the outputs of said sensing devices to obtain data for the operation of said rotary drive mechanism to achieve stabilized component data in a coordinate system that does not rotate with the said measurement apparatus, f) communication circuitry to transmit output data to auxiliary equipment at the surface or in the borehole, and g) support structure to support the elements a) through d).

3. The apparatus of claim 1 or claim 2 wherein said inertial angular rotation sensing device is an inertial-angular-rate-measuring gyroscope.

4. The apparatus of claim 1 or claim 2 wherein the coordinate system that does not rotate with the said measurement apparatus is referenced to the earth's gravity component normal to the borehole axis.

5. The apparatus of either claim 1 or claim 2 wherein the coordinate system that does not rotate with the said measurement apparatus is referenced to the earth's magnetic field component normal to the borehole axis.

6. The apparatus of claim 2 wherein the said inertial angular rotation sensing device having an axis of sensitivity along the borehole axis to sense inertial angular motion about the borehole axis, has a second axis of sensitivity normal to the borehole axis for use in determining the azimuthal orientation of the apparatus with respect to true North.

7. The method of making magnetic and gravity component measurements in a borehole, including measurements made while measurement apparatus is rotating about one axis extending lengthwise of the borehole, including the steps:

a) said apparatus provided to have a magnetic field component sensing device having at least two axes of sensitivity normal to the borehole axis and normal to each other, b) said apparatus provided to have a gravity field component sensing device having at least two axes of sensitivity normal to the borehole axis and normal to each other, c) said apparatus provided to have an inertial angular rotation sensing device having an axis of sensitivity along the borehole axis to sense inertial angular motion about the borehole axis, d) providing control, power and processing circuitry to operate said sensing devices and to process the outputs of said sensing devices to obtain stabilized component data in a coordinate system that does not rotate with the said measurement apparatus, e) and providing and operating communication circuitry to transmit output data to auxiliary equipment at the surface or in the borehole, f) and providing a rotary drive mechanism, having a gimbal to support said a), b) and c) sensing devices, said rotary drive mechanism controlled by said c) inertial angular rotation sensing device, for example a gyroscope, to rotate said a) sensing device about the borehole axis, or to permit stabilization of the gimbal and the sensitive axes of said a) sensing device with respect to a fixed coordinate system, for example inertial space, and wherein one of the following modes of operation and control for the drive mechanism is provided:

$x_1$) Stabilized directly to the inherent null output of the inertial angular rotation sensing device, $x_2$) Stabilized in any fixed position about the borehole axis using the inertial angular rotation sensing device referenced to one of the following:

a. referenced to accelerometer data b. referenced to magnetometer data c. referenced to a rotation angle sensor provided as part of the rotary drive mechanism, $x_3$) Continuous or intermittent rotation but controlled accurately to any selected rate or to any desired number of stopping points.

8. The method of claim 7 wherein said inertial angular rotation sensing device is provided and operated in the form of an inertial-angular-rate measuring gyroscope.

9. The method of claim 7 wherein the coordinate system that does not rotate with the said measurement apparatus is referenced to the earth's gravity component normal to the borehole axis.

10. The method of claim 7 wherein the coordinate system that does not rotate with the said measurement apparatus is referenced to the earth's magnetic field component normal to the borehole axis.

11. The method of claim 7 wherein said inertial angular rotation device is provided to have a first axis of sensitivity along the borehole axis to sense inertial angular motion about the borehole axis.

12. The method of claim 11 wherein said inertial angular rotation device is provided to have a second axis of sensitivity normal to the borehole axis for use in determining the azimuthal orientation of the apparatus with respect to true North.

13. Apparatus as defined in claim 7 including a rotary drive mechanism to rotate said sensing device about the borehole axis, or to permit stabilization of the sensitive axes of said sensing device with respect to a fixed coordinate system, and wherein one of the following modes of operation and control for the drive mechanism is provided:

$x_1$) Stabilized directly to the inherent null output of the inertial angular rotation sensor $x_2$) Stabilized in any fixed position about the borehole axis using the inertial angular rotation sensor referenced to one of the following:

a. referenced to accelerometer data b. referenced to magnetometer data c. referenced to a rotation angle sensor provided as part of the rotary drive means, $x_3$) Continuous or intermittent rotation but controlled accurately to any selected rate or to any desired number of stopping points.

14. The apparatus of claim 2 wherein said inertial angular rotation sensing device and its functioning are provided by the inertial of a stabilized mass associated with the rotary drive, and characterized by one of the following:

i) pendulous ii) non-pendulous.

15. The apparatus of claim 1 wherein said circuitry includes elements for resolving cross-axis measured components of the gravity field, designated as $A_x$ and $A_y$, an cross axis measured components of the magnetic field, designated $H_x$ and $H_y$, accordance with the following equations, wherein TF is tool force angle relating the angular orientation either to the gravity vectors $A_x$ and $A_y$ or to the magnetic field vectors $H_x$ and $H_y$:

$$A_x = A_x \bigstar \text{Cos}\ (TF) - A_y \bigstar \text{Sin}\ (TF) \quad (1)$$

$$A_y = A_x \bigstar \text{Sin}\ (TF) + A_y \bigstar \text{Cos}\ (TF) \quad (2)$$

$$H_x = H_x \bigstar \text{Cos}\ (TF) - H_y \bigstar \text{Sin}\ (TF) \quad (3)$$

$$H_y = H_x \bigstar \text{Sin}\ (F) = H_y \bigstar \text{Cos}\ (TF) \quad (4)$$

where Sin is the Sine of the angle and Cos is the Cosine of the TF angle.

* * * * *